US007329176B2

(12) United States Patent
Abe et al.

(10) Patent No.: US 7,329,176 B2
(45) Date of Patent: Feb. 12, 2008

(54) MOVABLE DISC GUIDING DEVICE FOR A HOPPER

(75) Inventors: Hiroshi Abe, Iwatsuki (JP); Takashi Inozuka, Iwatsuki (JP)

(73) Assignee: Asahi Seiko Kabushiki Kaisha, Tokyo (JP)

( * ) Notice: Subject to any disclaimer, the term of this patent is extended or adjusted under 35 U.S.C. 154(b) by 566 days.

(21) Appl. No.: 10/719,934

(22) Filed: Nov. 21, 2003

(65) Prior Publication Data

US 2004/0162015 A1 Aug. 19, 2004

(30) Foreign Application Priority Data

Nov. 22, 2002 (JP) ..... 2002-339744
Jul. 11, 2003 (JP) ..... 2003-273597
Oct. 22, 2003 (JP) ..... 2003-362467

(51) Int. Cl.
*G07D 1/00* (2006.01)

(52) U.S. Cl. ..... 453/49; 194/344

(58) Field of Classification Search ..... 453/48, 453/18, 29, 39, 63; 198/861.1–3, 861.5; 194/344; 193/17, 21, DIG. 1; 292/274, 292/271, 278

See application file for complete search history.

(56) References Cited

U.S. PATENT DOCUMENTS 2,853,083 A * 9/1958 Roedelheimer et al. ..... 453/39
3,662,770 A * 5/1972 Cohen ..... 453/40
3,730,575 A * 5/1973 Arlauskas et al. ..... 292/216
3,924,427 A * 12/1975 San Juaquin ..... 70/264
4,184,645 A * 1/1980 Starling ..... 242/441
4,230,136 A * 10/1980 Heinrichs ..... 453/11
4,725,027 A * 2/1988 Bekanich ..... 248/125.8
4,943,258 A * 7/1990 Abe ..... 453/30
4,978,153 A * 12/1990 Hirsch et al. ..... 292/201
5,876,275 A 3/1999 Rasmussen
5,897,148 A * 4/1999 Arabia et al. ..... 292/216
6,261,170 B1 * 7/2001 Bell et al. ..... 453/57
6,471,260 B1 * 10/2002 Weinerman et al. ..... 292/216
6,656,034 B2 * 12/2003 Rasmussen et al. ..... 453/56

FOREIGN PATENT DOCUMENTS

JP 6-3668 2/1994

* cited by examiner

*Primary Examiner*—Patrick Mackey
*Assistant Examiner*—Mark Beauchaine

(57) ABSTRACT

The present invention provides a guiding device for dispensing discs from a storage hopper and includes a disc guiding unit attached to the storage hopper to extend operatively for conveying discs in a first mode of operation and also attached relative to the storage hopper to extend in a second non-operative mode of operation wherein jammed coins can be removed and a disc dispensing apparatus can be provided in a compact configuration for transportation.

14 Claims, 18 Drawing Sheets

81
44
41
45
46
206
312
46
308
306
71
314
212
250
304
302
300
11
13

MOVABLE DISC GUIDING DEVICE FOR A HOPPER

BACKGROUND OF THE INVENTION

1. Field of the Invention

The present invention is directed to a guiding device for selectively dispensing discs, and more particularly, to a guiding unit that can be movable relative to a storage hopper to provide a compact configuration and facilitate removal of jammed discs.

2. Description of Related Art

Various forms of disc guiding units or coin elevators that can align a disc and permit discs to be selectively dispensed one by one from a hopper are known such as shown in U.S. Pat. No. 5,876,275. In this disclosure, the disc guiding unit can be modified to accommodate monetary coins of different dimensions.

Another example of the prior art can be found in the Japanese Utility Model 6-3668 which discloses a detachable disc guiding unit for resolving problems of coins that may be jammed in the disc guiding unit. When coin jamming occurs in the disc guiding unit, a dispensing side unit is detached from the hopper side guiding unit to enable the coins to be removed. A problem can occur, however, in that removing a disc guiding unit can be subject to damage and deformation. Additionally, the detaching and attaching of a disc guiding unit can be tedious and labor intensive.

Thus, the prior art is still seeking solutions to an efficient and economical disc guiding unit that facilities the removal of jammed coins, tokens or medallions.

SUMMARY OF THE INVENTION

A purpose of the present invention is to facilitate the removal of jammed coins while preventing any deformation and damage to a disc guiding unit where it is also desirable to provide a design that facilitates the introduction and removal of a hopper from a gaming machine, particularly when the opening or entrance is relatively small.

Another purpose of the present invention is to prevent dispensing of the disc when a dispensing side guiding unit is detached.

The present invention includes a disc guiding unit that can be attached to a hopper capable of dispensing discs in a selective one-by-one manner. The guiding unit includes a hopper side guiding unit and a dispensing side guiding unit. The disc guiding unit can be detachably mounted and also can be mounted so that the dispensing side guiding unit can pivot on a shaft located besides the guiding unit. If discs jam within the disc guiding unit, the dispensing side guiding unit can be pivoted on the shaft and thereby moved away from the hopper side guiding unit. As a result, the end faces of the guiding passageways are opened and discs that are jammed therein can then be removed from either the dispensing side guiding unit or the hopper side guiding unit.

Since the dispensing side guiding unit is movably mounted to the hopper, the opportunity of it to be damaged and detached is thereby limited.

Also, when the dispensing side guiding unit is pivoted, the height of the hopper with the guiding unit is relatively compact. Therefore, the entrance into a gaming machine through a small opening can be readily achieved. Subsequently, the dispensing side guiding unit can be pivoted on the shaft and then fixed at the hopper side guiding unit.

A buffering unit can be further utilized to limit the pivoting speed of the guiding unit, thereby reducing the possibility of damage. A fixing unit can also be provided to fix the dispensing side guiding unit.

The guiding device of the present invention includes a disc guiding unit attached to a storage hopper that can extend operatively away from the storage hopper for conveying discs in a first mode of operation for dispensing and further is attached to the storage hopper member to extend in a second non-operative mode of operation at a different alignment with the storage hopper. A pivotal connection member can enable the disc guiding unit to pivot relative to the storage hopper while a fixing unit can hold a disc guiding unit in an operative disc conveying mode.

The buffering unit can include a spring member that can provide an increasing amount of force to inhibit the relative rotation of the disc guiding unit as it moves from the first mode of operation to the second mode of operation.

The present invention can be implemented in a coin dispensing unit such as a gaming machine. A coin operator unit is operatively attached to a storage hopper that stores bulk coins. A rotating selector member can selectively remove coins from the hopper to a dispensing location. The coin elevator can be pivotally mounted to provide a storage position that is traverse to the operative coin dispensing direction in the first mode of operation.

Finally, the coin selector unit mounted within a coin storage hopper can be provided as a separate operative component with a pivotally attached coin elevator and a handle to permit a user to easily mount the component in a coin dispensing apparatus.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DETAILED DESCRIPTION OF THE PREFERRED EMBODIMENTS

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the intention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well known methods, procedures, components, and circuits have not been described in detail as not to unnecessarily obscure aspects of the present invention.

The terminology "disc" herein is broad enough to include token, medallions, monetary coins, and other objects of value which are to be stored in bulk and dispensed selectively.

Figure 1:
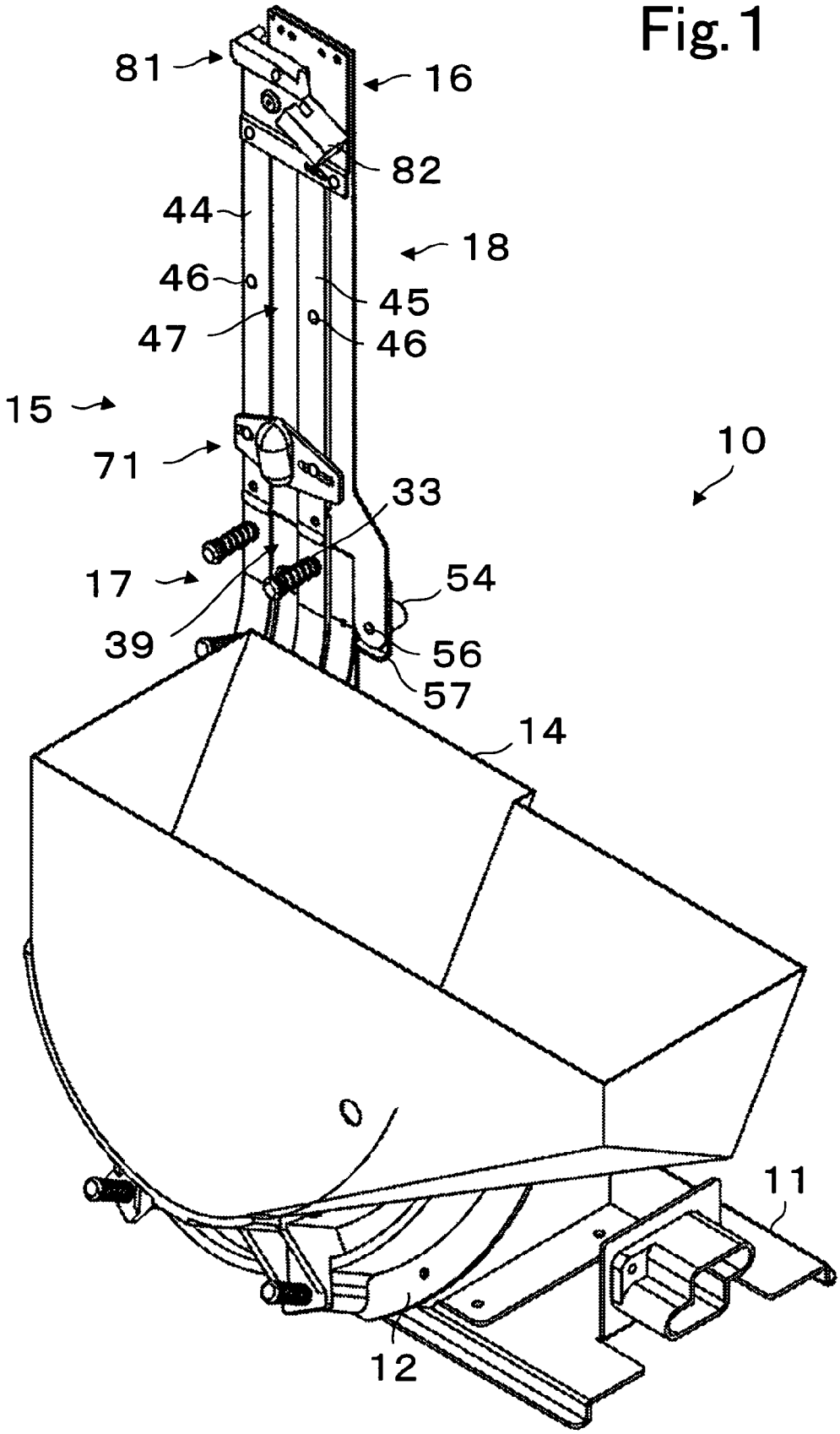
FIG. 1 is a perspective view of the hopper of a first embodiment.

Hopper 10 includes base 11, hopper base 12 which is fixed at base 11 at approximately 60 degrees, rotating disk plate or selector unit 13 for the selection of a disc D at the obverse side of hopper base 12 and coin storage bowl 14 which stores discs D as shown in FIG. 1. Bowl 14 is shaped like a rectangular box to store more discs in a predetermined space. For example, hopper 10 is known by the U.S. Pat. No. 4,589,433 which is incorporated herein by reference although other configurations of hoppers can be used.

A disc guiding unit 15 is fixed on hopper base 11, and discs D are let off by the rotating disk plate 13, one by one, to be aligned in the disc guiding unit 15, and are dispensed by count sensor 16, one by one, at dispensing section at one end. Disc guiding unit or coin elevator unit 15 includes a hopper side guiding unit 17 which is fixed at the hopper base 12 and a dispensing side guiding unit 18. In this embodiment, the disc guiding unit is made up of two equal parts; however, it can be made up of more parts.

Hopper side guiding unit 17 includes a hopper side base plate 19 which is rectangular in shape and is fixed at base 12. A pair of rectangular spacers 21,22, which are slightly thicker than the thickness of a disc D, a pair of upper side holding plate 23,24 which have contact with spacers 21,22.

Figure 2:
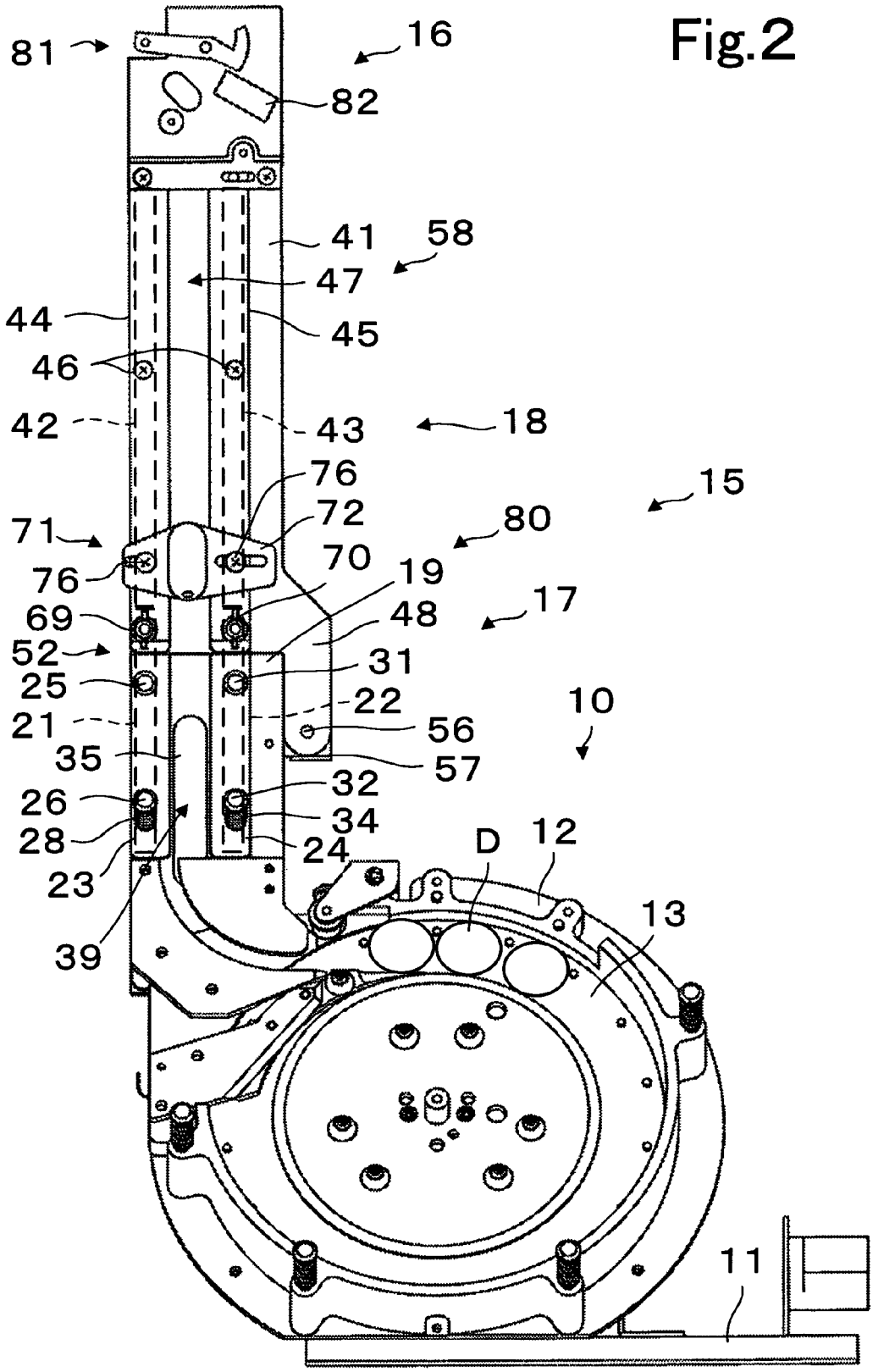
FIG. 2 is a front view of the hopper of the first embodiment deleting the bowl.

The distance between a pair of spacers 21,22 is slightly larger than the diameter of disc D and can be set for a particular size such as a monetary coin. The distance between holding plate 23,24 is smaller than the distance between spacers 21,22. The holding plate 23 and the spacer 21 are fixed at a hopper side base plate 19 by screws 25,26 as shown in FIG. 2.

Figure 4:
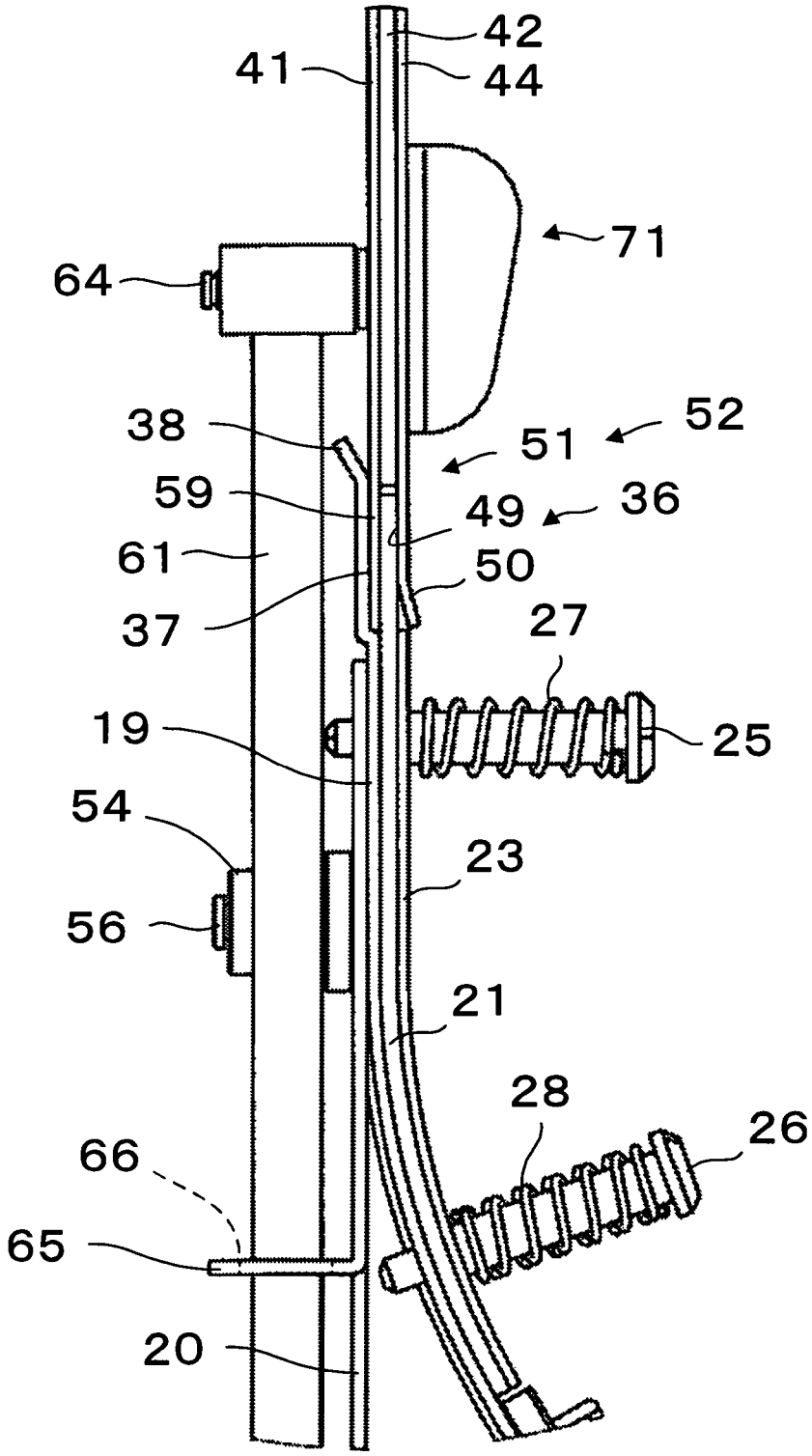
FIG. 4 is an enlarged left-hand side view of the separating section of the first embodiment.
Figure 5:
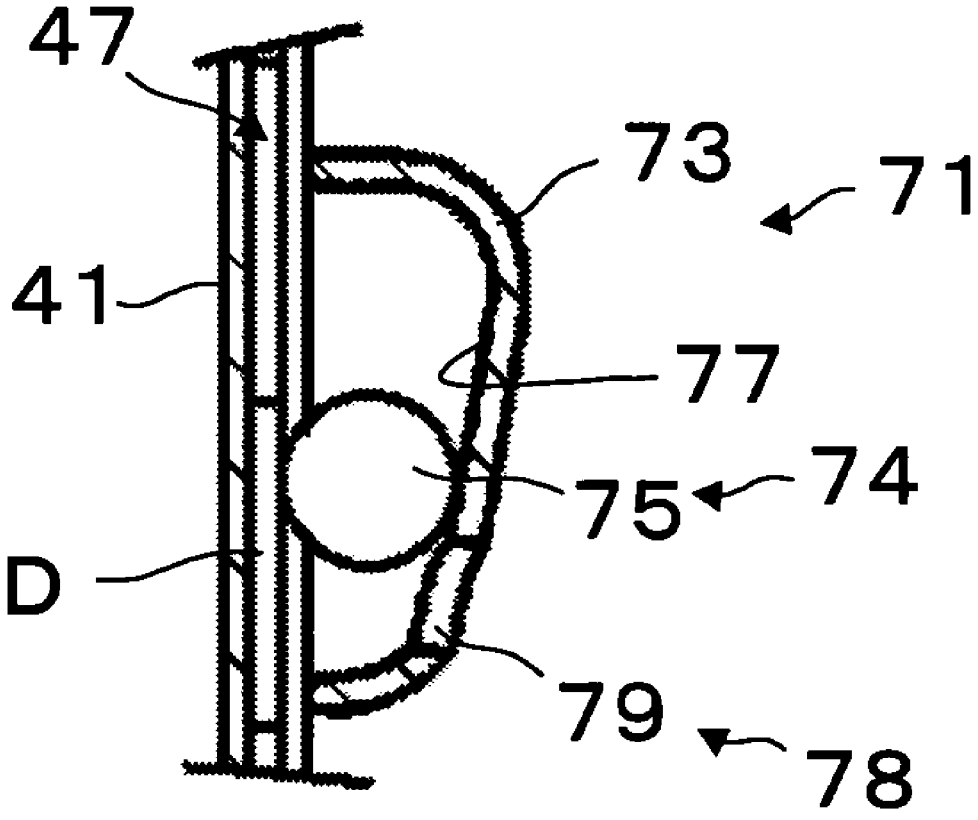
FIG. 5 is a part cross-section view of the holding device of the first embodiment.

Spacer 21 and holding plate 23 are held on base 19 by springs 27,28 which are located between the holding plate 23 and the heads of the screws, which are combined integrally, see FIG. 4. Also, holding plate 24 and spacer 22 are fixed at base 19 by screws 31,32. Spacer 22 and supporter 24 are also pushed on base 19 by springs 33,34 which are located between supporter 24 and the heads of screws, which are also combined integrally.

Figure 3:
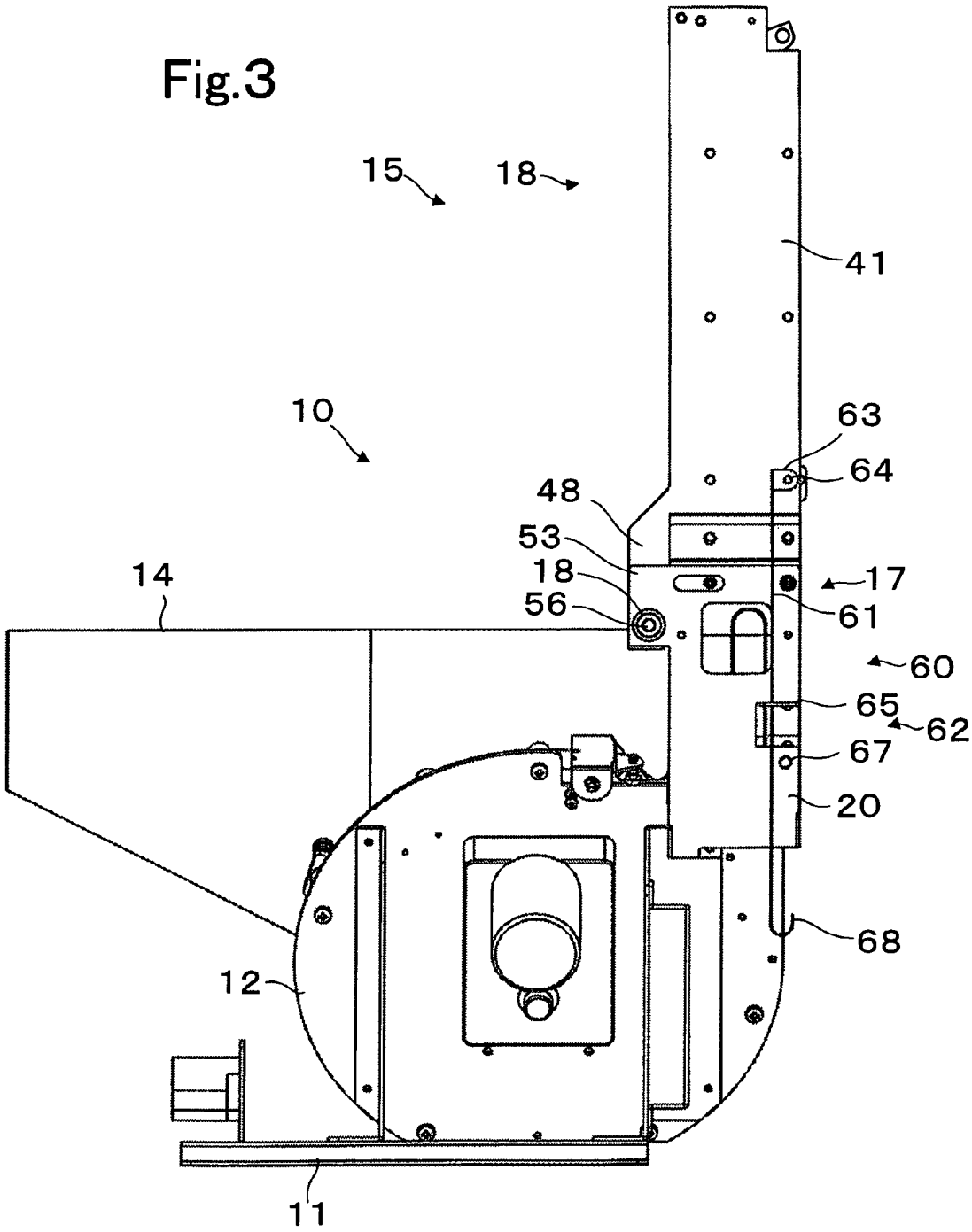
FIG. 3 is a rear view of the hopper deleted of the bowl of the first embodiment.

Groove 35 has a U-shape cross-section and extends longitudinally so that it is located at the middle of hopper side base plate 19 and can transport discs. Hopper side guiding unit 17 slants approximately at a 60-degree angle to the fixed section of hopper base plate 12. The upper end is a hopper side combining section 36 and is perpendicular. The lower section of hopper side base plate 19 is fixed at the upper section of supporting boss 20 by bolts (not shown). The lower section of supporting boss 20 is fixed at base plate 11 as shown in FIG. 3.

Supporting boss 20 provides supporting structure to hopper side guiding unit 17. Hopper side combining section 36 has a hopper side concave section 37 for receiving a dispensing side base plate 41, see FIG. 4. The upper section of base plate 19 is crank-like in shape. The concave section 37 is structured between the base plate 19 and the hopper side spacers 21,22. The upper section of base plate 19 slants towards the outside and provides structure for hopper side guide 38. Hopper side guiding passageway 39 is enclosed by base plate 19, spacers 21,22 and holding plates 23,24 and is rectangular across its cross-section and extends perpendicular.

Next, dispensing side guiding unit 18 is explained. Dispensing side guiding unit 18 includes a dispensing side base plate 41 which is rectangular, a pair of spacers 42,43 which are slightly thicker than the thickness of the disc D and rectangular-shaped like an elongated plate, and a pair of dispensing side holding plates 44,45 which have contact with spacers 42,43. The distance between spacers 42 and 43 is the same as the distance between spacers 21 and 22. The distance between holding plates 44 and 45 is the same as the distance between holding plates 23 and 24 so that a disc is provided a constant size passageway.

Dispensing side spacers 42,43 are sandwiched between holding plates 44,45 and base plate 41 because of screws 46 screwed into base plate 41. The dispensing side guiding passageway 47 is enclosed by base plate 41, spacers 42,43 and holding plates 44,45. Stay 48 is located under base plate 41, is located beside guiding passageway 39 and extends downwards rather than towards spacers 42,43.

Dispensing side holding plates 44,45 also extend downward the same as base plate 41. Dispensing side concave portion 49 is structured between base plate 41 and holding plates 44,45. The lower sections of holding plates 44,45 and base plate 41 structure dispensing side combining section 51. Hopper side spacers 21,22 can be inserted into dispensing side concave portion 49. The lower sections of holding plates 44,45 slant towards the outside which makes up dispensing side guide 50.

A separating section 52 is structured by a dispensing side combining section 51 and hopper side combining section 36 as seen in FIG. 2. Bearing 54 is a cylinder and is fixed at attaching section 53 which extends towards a side from supporting body 20. The attaching section 53 is located beside guiding passageway 39 and is lower than separating section 52. The lower section of attaching section 53 is at an approximate right angle which makes up the first stopper 57 as shown in FIG. 1. Attaching section 53 can be made up of the extending section of base 19. Shaft 56 is fixed at stay 48 of base plate 41 and can pivot on a bearing 54 which has a predetermined length. The length of shaft 54 is longer than the diameter of shaft 56, as seen in FIG. 3.

Therefore, the axis line of shaft 56 crosses a hypothetical plane which includes a disc guiding passageway 58 (hopper side guiding passageway 39 and dispensing side guiding passageway 47) at a right angle. In other words, dispensing side guiding passageway 47 can pivot in a plane which includes the upper section of hopper side guiding passageway 39. When dispensing side guiding unit 18 pivots at a predetermined angle and is approximately upright, first stopper 57 has contact with stay 48, see FIG. 2.

Therefore, guiding unit 15 can be separable to cross at a right angle at combining section 52 which is located in the middle longitudinal. Lower section 59 of dispensing side base plate 41 is inserted into hopper side concave 37. Hopper side spacers 21,22 are inserted into dispensing side concave 49. Butterfly bolts 69,70 penetrate dispensing side holding plates 44,45, hopper side spacers 21,22 and lower section 59 of dispensing side base plate 41, and screw into hopper side base plate 19. Fixing unit 80 is a pair of butterfly bolts 69,70. Therefore, dispensing side guiding unit 18 is fixed at the upper section of hopper side guiding unit 17.

As a result, hopper side guiding unit 39 and dispensing side guiding unit 47 are combined together in the vertical longitudinal direction and make up a disc guiding passageway or coin elevator 58 which extends perpendicular. In other words, dispensing side base plate 41 is located on an extending line of hopper side base plate 19, dispensing side spacer 42 is located on the extending line of hopper side spacer 21, dispensing side spacer 43 is located on the extending line of hopper side spacer 22, dispensing side holding plate 44 is located on the extending line of hopper side holding plate 23, and dispensing side holding plate 45 is located on the extending line of hopper side holding plate 24.

Figure 6:
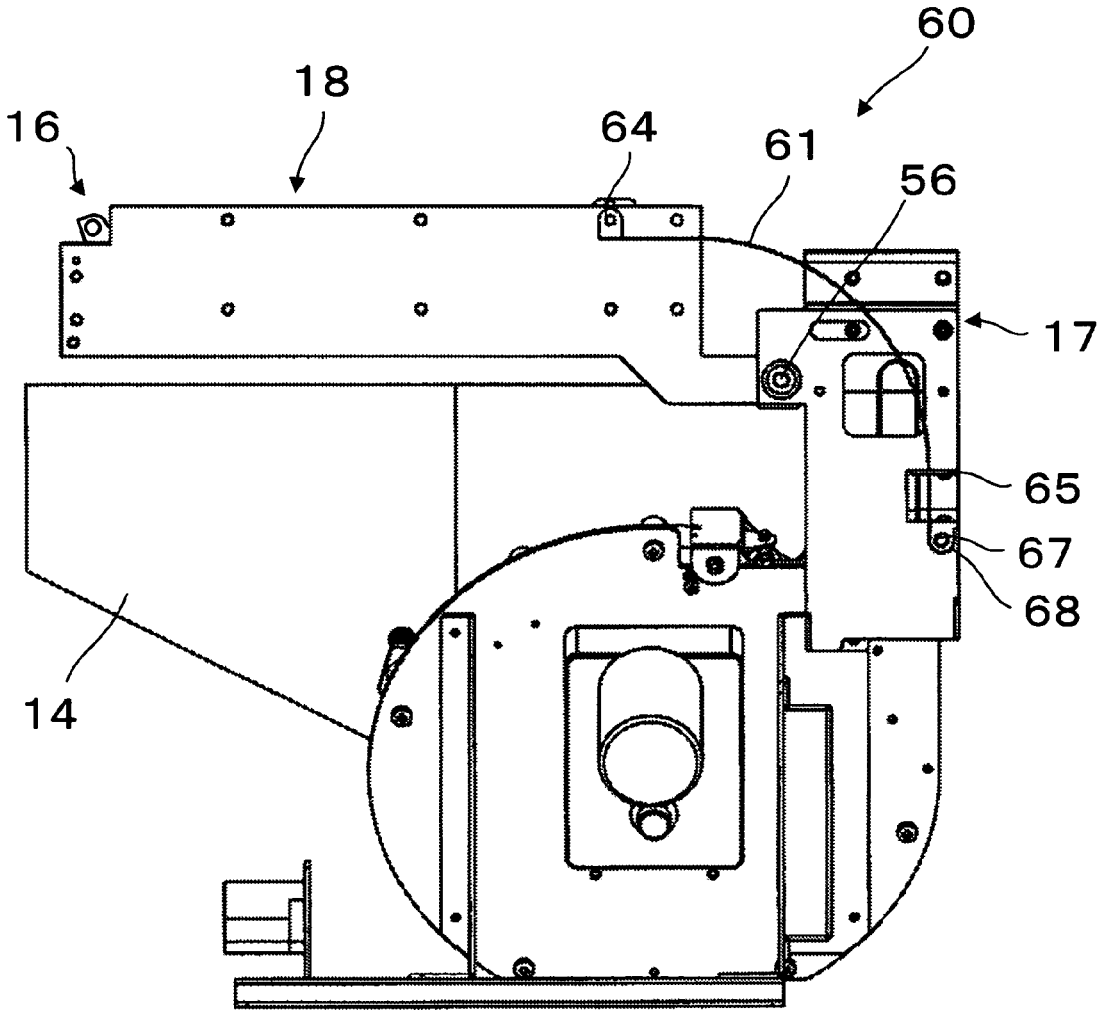
FIG. 6 is a rear view side of the hopper when the dispensing guiding unit is pivoted in the first embodiment.

Next, a speed buffering unit 60 is explained in FIG. 6. Buffering unit 60 has a function to reduce or control the pivoting speed of dispensing side guiding unit 18. In other words, when the dispensing side guiding unit 18 is stopped, any shock impact is buffered. As shown in FIGS. 3 and 4, buffering unit 60 includes a spring 61 and a guide 62. Spring 61 is a leaf spring; in this embodiment, however, it can be changed to either a bar spring, a coil spring or other spring type. Fixed bearing 63 at the upper section of spring 61 can pivot on pin 64 which is fixed at the rear of dispensing side base plate 41. When bearing 63 is fixed at pin 64, the buffering effect increases.

Next, guide 62 is explained. Guide 62 has a function of permitting elastic deformation because the deformation of spring 61 is limited. Guide 62 includes rectangular guiding hole 66 which is located at guiding board 65 which can bend to a level position at supporting boss 20 and guiding bar 67 which is level and is located under guiding board 65 and is fixed at supporting boss 20. The lower section of spring 61 penetrates guiding hole 66 and is located at the side of shaft 56 than guiding bar 67. The lower end of spring 61 is U-shaped and forms stopper or hook 68.

When dispensing side guiding unit 18 pivots on shaft 56, the lower section of spring 61 is kept perpendicular by guiding hole 66 and guiding bar 67. Therefore, dispensing side guiding unit 18 receives a force directed in a clockwise direction by spring 61 as shown in FIG. 3.

Accordingly, when the pivoting of dispensing side guiding unit 18 increases about the shaft 56, the spring force increases too. In other words, the pivoting speed is reduced and, as a result, the shock of dispensing side guiding unit 18 is buffered. Stopper 68 is stopped or captured by guiding bar 67; therefore, the sliding of spring 61 in guide 62 is stopped. Finally, the shock of dispensing side guiding unit 18 is buffered by the movement of spring 61 and is stopped by the first stopper 57. Guide 62 can be changed to a guiding hole which extends perpendicular. In such an embodiment, the functions of guiding hole 66 and guiding bar 67 are unified.

When dispensing side guiding unit 18 pivots on shaft 56 and is positioned in a horizontal level position, counting sensor 16 is located at the inside rather than the side end of bowl 14 as shown in FIG. 6. Therefore, when the device is moved or mishandled, the sensor is further protected by the presence of the bowl 14.

A disc holding unit 71 is fixed at the lower section of dispensing side guiding unit 18. Holding unit 71 includes guiding section 73 and stopper 74. Guiding section 73 is located beside dispensing side guiding passageway 47 and in the middle of stay 72 and has a half egg-like shape. Stopper 74 is located at guiding section 73 and is, for example, a ball 75.

Stay 72 is fixed at holding plates 44,45 by screws 76 which screw into base plate 41. The extending line of slanting surface 77 inside the guiding section 73 crosses to dispensing side guiding passageway 47 at an acute angle.

When holding unit 71 is located at a lower position in the embodiment, the extending line of slanting surface 77 crosses the hopper side guiding passageway 39 at an acute angle. In other words, the distance between slanting surface 77 and dispensing side guiding passageway 47 is narrower than at the lower section. Accordingly, when ball 75 is dropped by gravity, it moves toward dispensing side guiding passageway 47 by the slanting surface 77.

Therefore, a disc D can be pushed to dispensing side base plate 41 by ball 75, and it is kept at that position.

Ball 75 is made of iron and has an appropriate surface plating. Stopper 74 can be changed to an alternate unit which has the same function of holding a disc. Also stopper 74 could be changed to a wedge shape member.

When holding unit 71 is structured by a stopper 74 which utilizes gravity and a slanting surface 77, it is less expensive because it doesn't use a driving unit. Releasing unit 78 is located at the lower section of slanting surface 77. In this embodiment, releasing unit 78 is an opening 79. Opening 79 can be made up from a circle (shown in embodiment), rectangle, oval, slot or etc.

In other words, a bar-type tool such as a screwdriver can be inserted in opening 79, and ball 75 is moved by the tool. Releasing unit 78 has a function of releasing the disc held by the holding unit 71.

When ball 75 contacts the disc, it is located above rather than the lower edge of opening 79. Therefore, when ball 75 is moved towards the side of counting sensor 16 by a screw driver which is inserted at opening 79, disc D is released. Holding unit 71 can be changed to another unit which has the same the function of holding a disc D in dispensing side passageway 47.

Counting sensor 16 of dispensing side guiding unit 18 includes projecting unit 81 and sensor 82. Projecting unit 81 is known as in U.S. Pat. No. 4,592,377 which is incorporated by reference herein. When projecting unit 81 pivots, it faces sensor 82. Therefore, sensor 82 outputs a counting signal as shown in FIG. 1.

Next, the operation of the first embodiment is explained. When rotating disc 13 rotates, it lets off discs D to guiding passageway 39 of hopper side guiding unit 17 one by one. In other words, discs D are aligned in hopper side guiding passageway 39 and have contact with each peripheral. Discs D are pushed by a new disc D which is let off from the rotating disk 13, and they reach dispensing side guiding passageway 47. The top disc D in the dispensing side guiding passageway 47 is dispensed by projecting unit 81. The movement of projecting unit 81 is detected by sensor 82, afterwards the sensor 82 outputs a signal for counting the dispensed discs D.

Next, the separation between dispensing side guiding unit 18 and hopper side guiding unit 17 is explained. First, butterfly bolts 69,70 are released and are taken away from dispensing side guiding unit 18. Next, dispensing side guiding unit 18 is moved from a vertical perpendicular position as shown in FIG. 3 to a horizontal position as shown in FIG. 6 in a counterclockwise direction.

In this process, the lower section of spring 61 is guided by guiding hole 66 and guiding bar 67. Therefore, the lower section is kept at the perpendicular situation, and spring 61 is transformed to an arc shape. The pivoting speed of dispensing side guiding unit 18 is reduced according to this deformation. In addition, the deformation of spring 61 increases because stopper 68 is stopped by the guiding bar 67. As a result, the pivoting speed is reduced. Finally, stay 48 is stopped by first stopper 57, and dispensing side guiding unit 18 is stopped.

When dispensing side guiding unit 18 is stopped by first stopper 57, any shock will be reduced drastically because the pivoting speed is reduced. Accordingly, dispensing side guiding unit 18 is separated from hopper side guiding unit 17. At the same time, discs D in dispensing side guiding passageway 47 fall down by gravity. Ball 75 of holding unit 71 also falls down by gravity and is moved toward dispensing side base plate 19 by the slanting surface 77.

Therefore, disc D is pushed to dispensing side base plate 41 by ball 75 and is kept at that position. As a result, disc D cannot fall down from dispensing side passageway 47. The discs D are stacked and are stopped by the last disc D which is held in dispensing passageway 47.

The lower disc D is located under ball 75, and falls down. The lower disc D is only one or two discs, because ball 75 is located at a lower section of dispensing side guiding passageway 47. When the disc D falls down, the recycling work is easy, because there are only one or two discs. In this situation, the hopper can further be packaged and transported. Accordingly, the packaging height is lower, and, as a result, transporting efficiency is improved.

When discs D are to be taken away from dispensing side guiding unit 18, a screwdriver is inserted through opening 79, and ball 75 is pushed up. Therefore, ball 75 isn't pushed towards disc D or dispensing side base plate 41. As a result, disc D can move in dispensing side guiding passageway 47. In this situation, jammed discs D are moved and are taken away from dispensing side guiding passageway 47.

The jammed discs D in hopper side guiding passageway 39 are removed as above mentioned, and afterwards dispensing side guiding unit 18 is connected with hopper side guiding unit 17 in the opposite steps of the above-mentioned procedure. In other words, dispensing side guiding unit 18 pivots on shaft 56 and is positioned in vertical alignment.

In this process, dispensing side base plate 41 and dispensing side holding plates 44,45 pivot in a plane which is parallel to the hopper side concave 37. First, lower section 59 of dispensing side base 19 goes into hopper side concave 37. Also, the upper section of hopper side spacer 22 goes into dispensing side concave 49.

Next, the upper section of hopper side spacer 21 goes to dispensing side concave 49. In this process, hopper side combining section 36 and dispensing side combining section 51 are combined in the lateral direction because shaft 56 is located beside guiding passageway 58. Accordingly, lower section 59 is guided by hopper side concave 37, and hopper side spacers 21,22 are guided by the dispensing side concave 49.

When the pivoting plane is out of alignment, lower section 59 is guided by the slanting section of hopper side guide 38 and hopper side spacers 21,22 are guided by dispensing side guide 50 into dispensing side concave 49. When hopper side guiding passageway 39 and dispensing side guiding passageway 47 are aligned, butterfly bolts 69,70 are screwed into hopper side base 19 and are combined. Therefore, hopper side guiding unit 17 and dispensing side guiding unit 18 are combined.

Also, when dispensing side guiding unit 18 pivots on shaft 56 to a level position, for example, the upper end of ball 75 is lower. When the entrance of gaming machine for the hopper is small, the present hopper can be taken in or out easily.

When the hopper is either in or out of the gaming machine, the dispensing side guiding unit 18 is removed as mentioned, and is fixed at hopper side guiding unit 17 by screws 69,70. Thus, the assembly and disassembly of a gaming machine is made much easier.

Now the structure of the second embodiment is explained with FIGS. 7 through 13, and the same structures as the first embodiment are provided with the same reference numbers.

The supporting body 20 of the second embodiment is channel-like in shape at a cross-section, and the lower section can be fixed at base 11; however, it isn't necessary to fix it. Hopper side connecting section 36 has a tier 201. The upper section of base 19 is bent horizontally and forms a guiding section 65 seen in FIG. 10, because of the strengthening and is made up of an after-mentioned guiding hole 66. Dispensing side spacers 21,22 extend downwards the same as base 19. The lower sections of spacers 21,22, the lower section of base 19 and the lower section of holding plate 23,24 and base plate 19 structure dispensing side connecting section 49. The lower sections of holding plates 44,45 slant towards the outside which makes up dispensing side guide 202.

Shaft 204 is fixed between the side wall supporting body 20 which is channel-like in shape and extends horizontally. Also shaft 204 is located beside hopper side guiding passageway 39 and is under a combining section 51. Therefore, the axis line of shaft 204 crosses a hypothetical flat surface which includes a disc face in guiding passageway 58 (hopper side guiding passageway 39 and dispensing side guiding passageway 47) at a right angle. In other words, dispensing side guiding passageway 47 can pivot in a plane which includes the upper section of hopper side guiding passageway 39.

Figure 7:
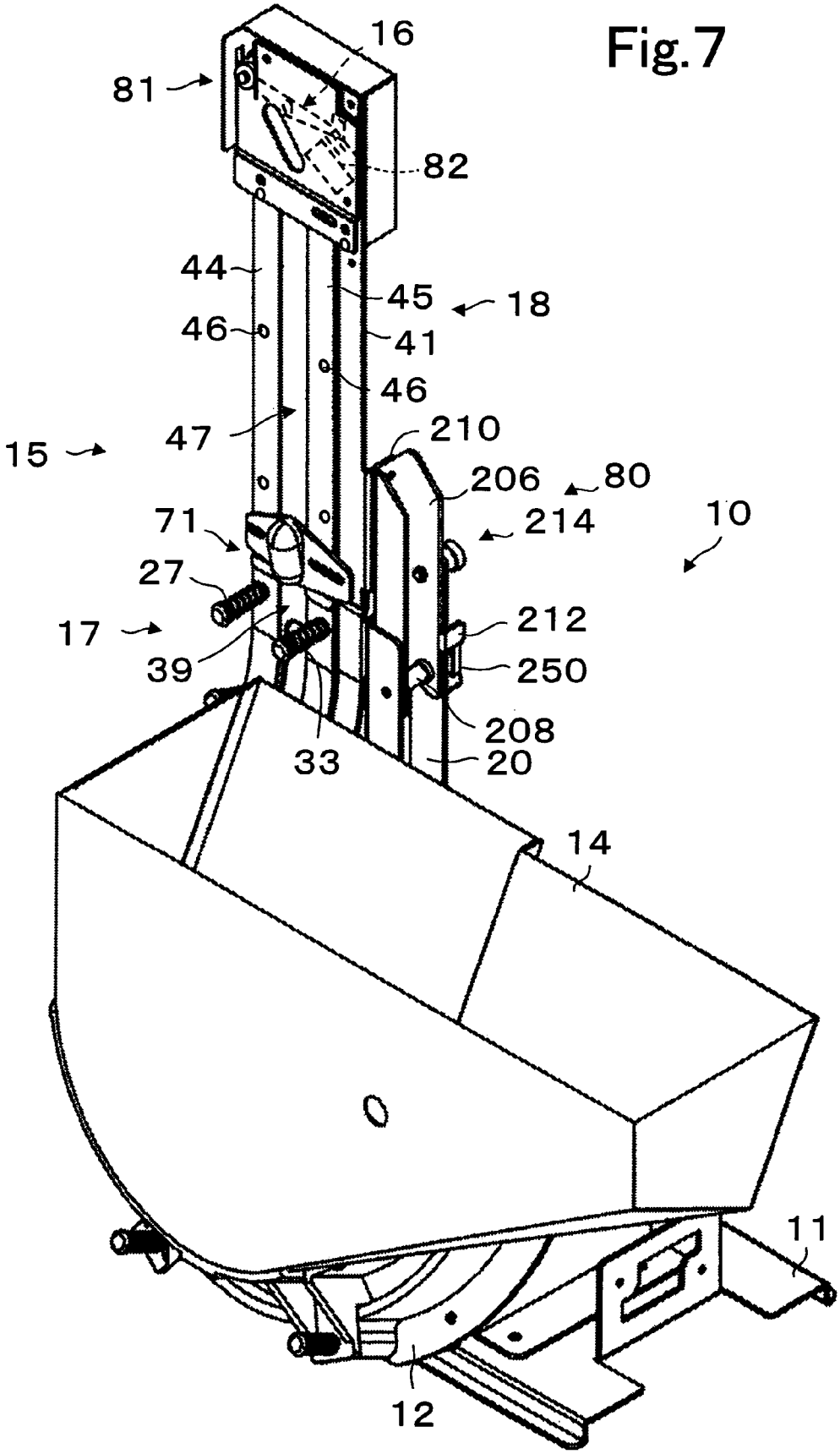
FIG. 7 is a perspective view of the hopper with the guiding unit of the second embodiment.
Figure 8:
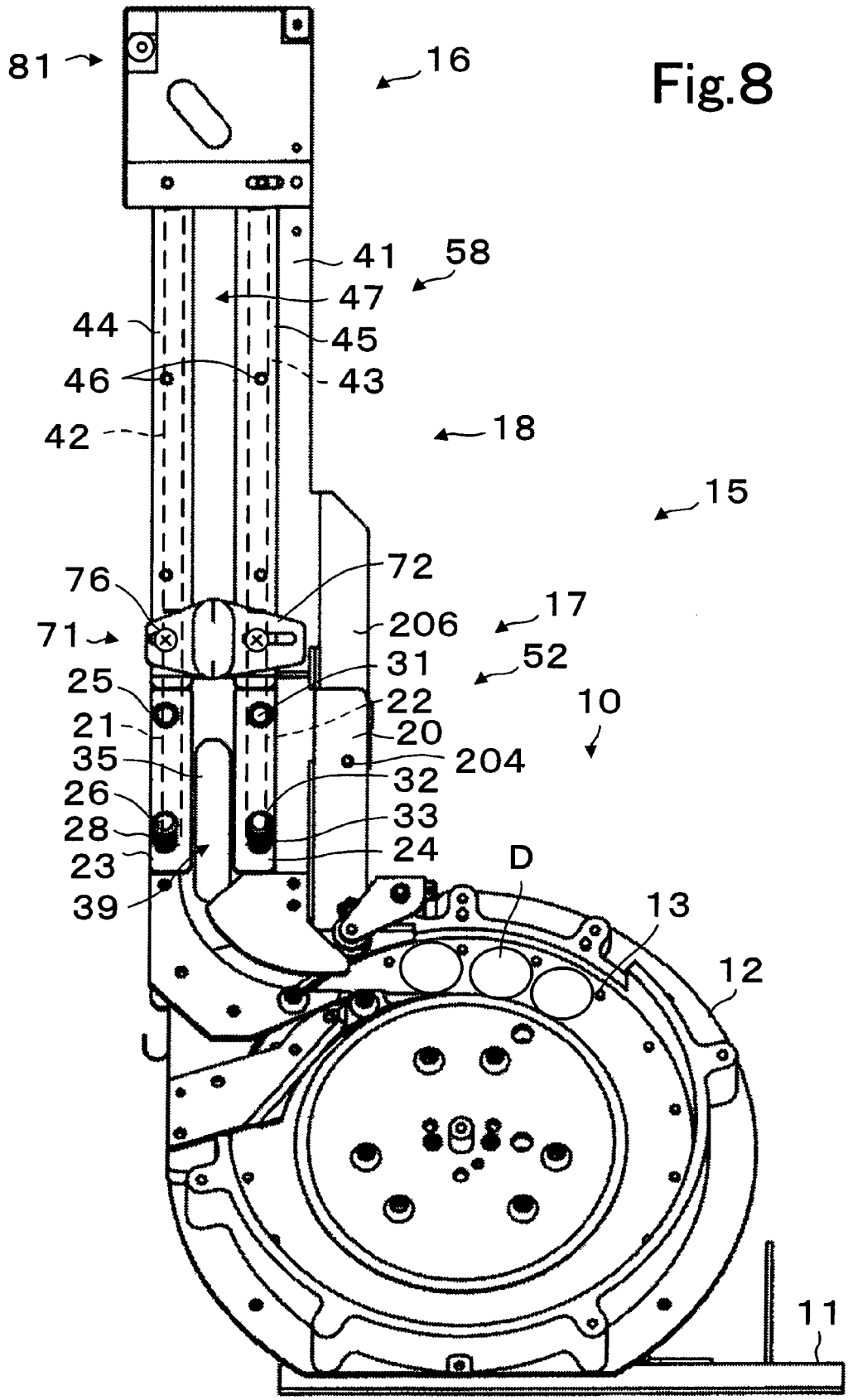
FIG. 8 is a front view of the hopper which deleted the bowl and includes the guiding unit of the second embodiment.

Bearing 208 is a rotatable cylinder and is fixed between the side walls at the lower section of lever 206 which is channel-like in shape. The lower section of lever 206 is located at the groove of supporting body 20 as shown in FIG. 7. Therefore, lever 206 can pivot in a plane which is parallel to a plane which includes guiding passageways 39 and 47 and guiding unit 15 can be separable to cross at a right angle at connecting section 52 which is located in the middle of the longitudinal axis.

Attaching section 210 is bent at a right angle at the right end of dispensing side base plate 41 and is fixed at the bottom 207 of the upper section of lever 206. Operating section 212 is at an end of the side wall of lever 206 which is bent to a right angle to guiding passageway 58. These structures are stronger and smaller because the supporting body 20, and lever 206 is channel-like in shape.

Figure 12:
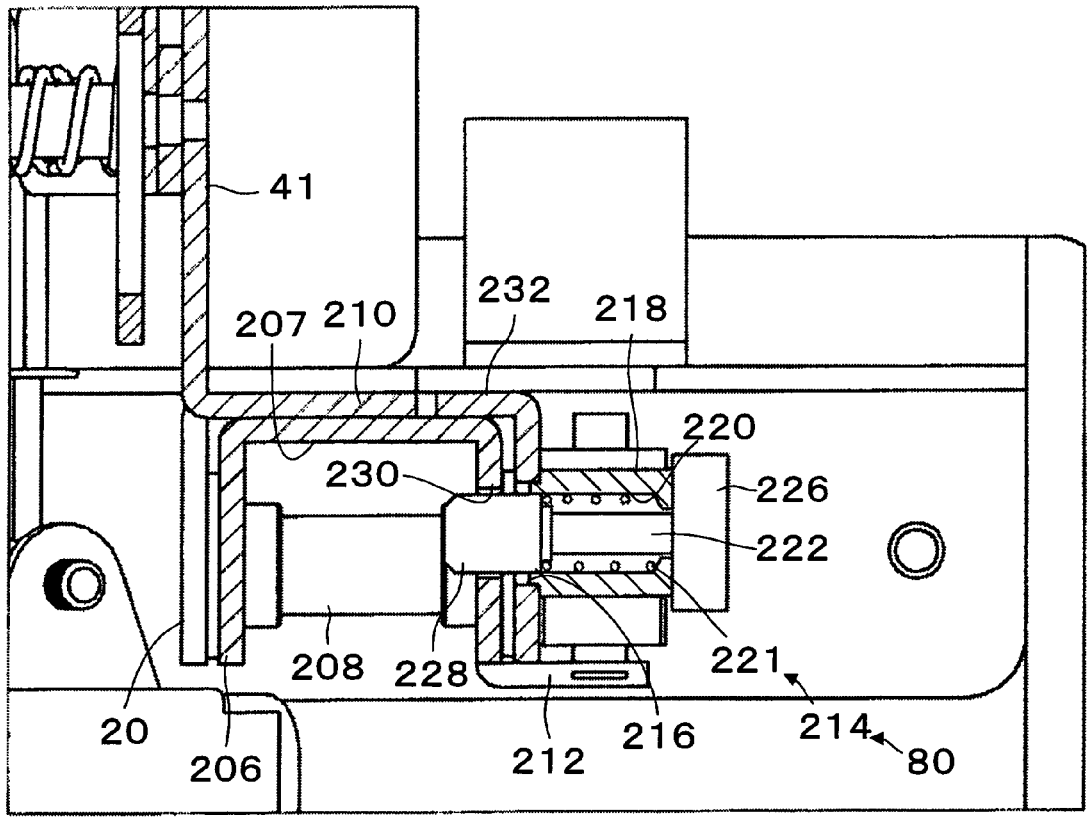
FIG. 12 is a cross-section view along A-A line in FIG. 4 of the fixing unit in the second embodiment.

Next fixing unit 80 for the dispensing side guiding unit 18 is explained. Fixing unit 80 is, for example, a one-touch fixing unit 214 for easier operation as seen in FIG. 12. One-touch fixing unit 214 includes cylinder 218, slider 222, spring 221 and stopper 226. Cylinder 218 is pressed into a hole 216 which is located at the upper section of supporting body 20. Slider 222 can slide within hole 220 of cylinder 218. Slider 222 protrudes outside and is pushed by spring 221. Stopper 226 stops movement of slider 222.

Pin section 228 at the end of slider 222 has a chamfered edge at one end and is inserted into through hole 230 which is located at lever 206. When pin section 228 penetrates into through hole 230, dispensing side guiding unit 18 is located on an extending axis of hopper side guiding unit 17. In other words, dispensing side guiding passageway 47 is located vertically on the extending line of hopper side guiding passageway 39, and they together form the structure for disc guiding passageway 58.

Stopper 226 can be held by an operator, and moved towards the right as shown in FIG. 12. Therefore, slider 222 moves out from through hole 230. Lever 206, in other words, dispensing side guiding unit 18 can pivot at shaft 204. As a result, dispensing side guiding unit 18 can be moved to a horizontal position. When dispensing side guiding unit 18 is returned, stopper 226, in other words, slider 222, is moved towards the right, and the end of pin section 228 is pulled into cylinder 218. Afterwards, dispensing side guiding unit 18 can be pivoted; then bottom wall 207 of lever 206 has contact with stopper 232 which has a L cross-section and extends from supporting body 20.

In this situation, pin section 228 faces through hole 230. Therefore, stopper 226 is released. Slider 222 is moved automatically to the left by spring 221. Then pin section 228 proceeds into through a locking hole 230, and dispensing side guiding unit 18 is again fixed.

In this situation, dispensing side base 19 is located on the extending line of hopper side base 19, dispensing side spacer 42 is located on the extending line of hopper side spacer 21, dispensing side spacer 43 is located on the extending line of hopper side spacer 22, dispensing side supporter 44 is located on the extending line of hopper side supporter 23 and dispensing side supporter 45 is located on the extending line of hopper side supporter 24. Accordingly, hopper side guiding passageway 39 is connected with dispensing side guiding passageway 47, and they together make up guiding passageway 58 which can extend perpendicular. The upper section of spring 61 is fixed at stay 234 which penetrates towards the rear from base plate 41 at a right angle. Material with the elasticity of spring 61 can be chosen from iron, resin, FRP, or etc., however, steel is best, because it is cheaper and has a long life.

Figure 13:
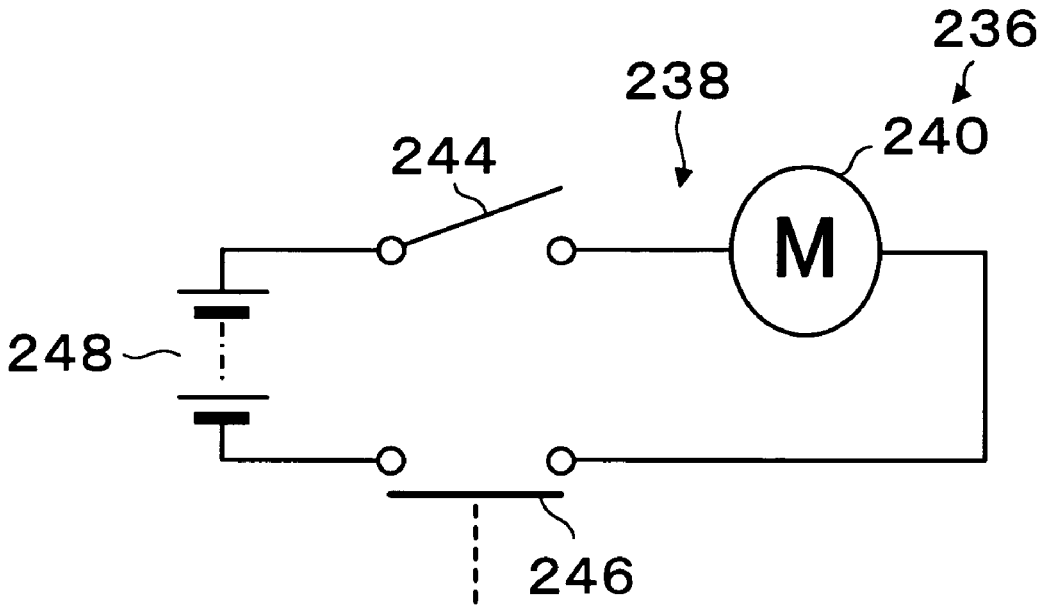
FIG. 13 is a circuit diagram of the second embodiment.
Figure 14:
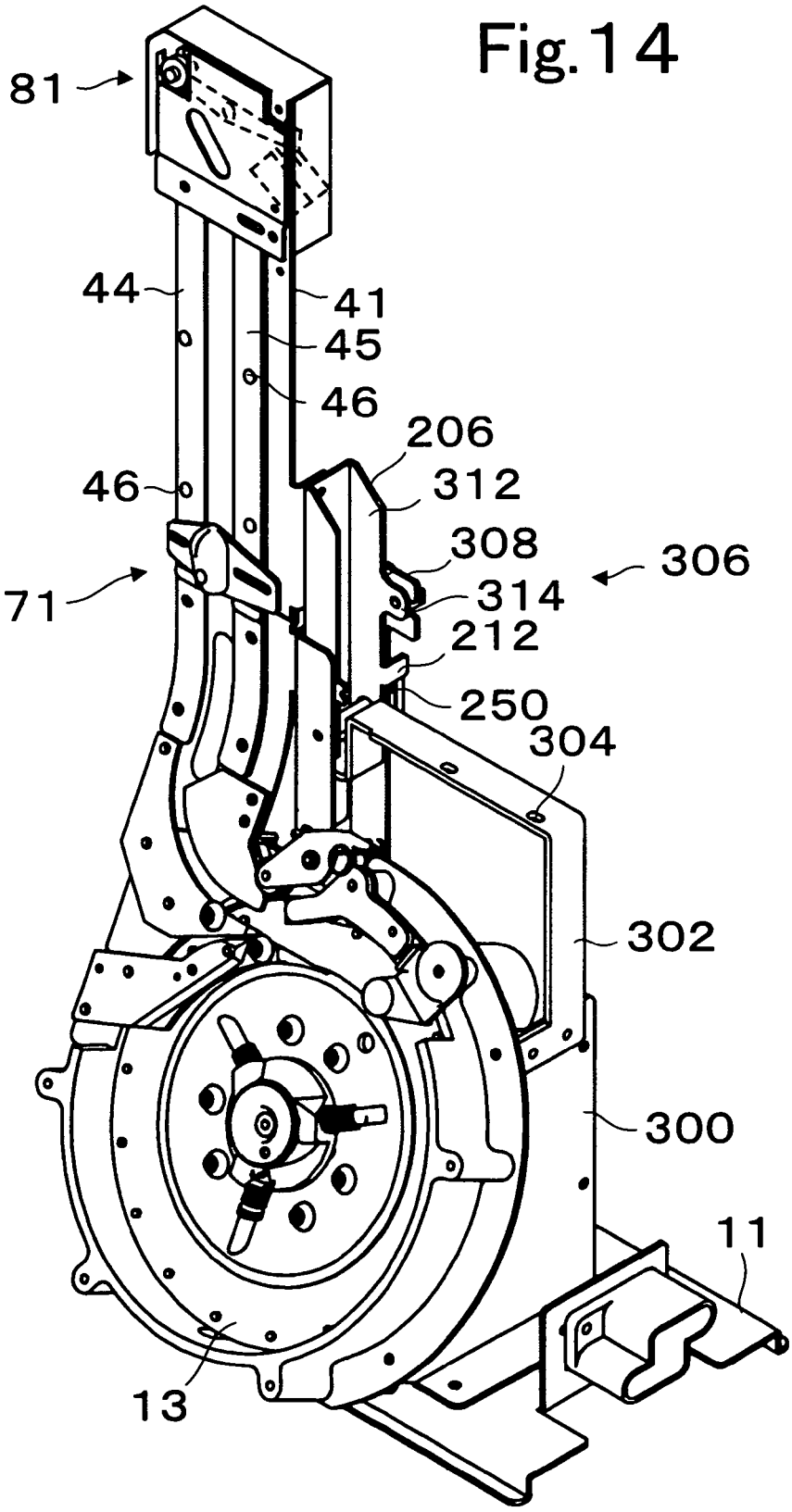
FIG. 14 is a perspective view of the hopper with the guiding unit of the third embodiment.

Next, controlling circuit 238 of electrical driving unit 236 of hopper 10 is explained in FIG. 13. Electrical driving unit 236 is an electrical motor 240 which drives the rotating disc in the hopper through a reducer unit 242. Electrical motor 240 is connected in series with a micro switch 244, a contactor 246 which is opened or closed by a controlling unit (not shown) of a gaming machine and a power source 248.

When micro switch 244 is opened, motor 240 does not rotate. The dispensing side guiding unit detecting device is micro switch 244; however, it can be changed to another switch unit which can have the same function. Micro switch 244 is fixed at the side wall of supporting body 20. Driven piece 250 of micro switch 244 is pushed by operating piece 212 and is located at the "ON" position.

When dispensing side guiding unit 18 is fixed by fixing unit 48, driven piece 250 is pushed by operating piece 212. Therefore, micro switch 244 becomes "ON". When the driven piece 250 is not pushed, micro switch 244 is "OFF". In other words, when dispensing side guiding unit 18 falls, micro switch 244 is "OFF" and controlling circuit 238 continues in the open situation; however, contactor 246 is closed.

Next, the operation of the second embodiment is explained. When dispensing side guiding unit 18 is located at the extending line of hopper side guiding unit 17 and is fixed by fixing unit 80, driven piece 250 of micro switch 244 is pushed by operating piece 212. Therefore, micro switch 244 is "ON". When contactor 246 became "ON" by the gaming machine controlling unit, controlling circuit 238 becomes "ON"; therefore, motor 240 rotates. Rotating disc 13 rotates by motor 240, and lets off a disc D into guiding passageway 39 of hopper side guiding unit 17, one by one. In other words, discs D align in hopper side guiding passageway 39 and have contact with each other on their peripheral sides.

Discs D are pushed by an entering new disc D which is let off from rotating disk 13, and they reach dispensing side guiding passageway 47. The top disc D in dispensing side guiding passageway 47 is dispensed by projecting unit 81. The movement of projecting unit 81 is detected by sensor 82; afterwards the sensor 82 outputs a signal for counting the dispensed discs D.

Figure 9:
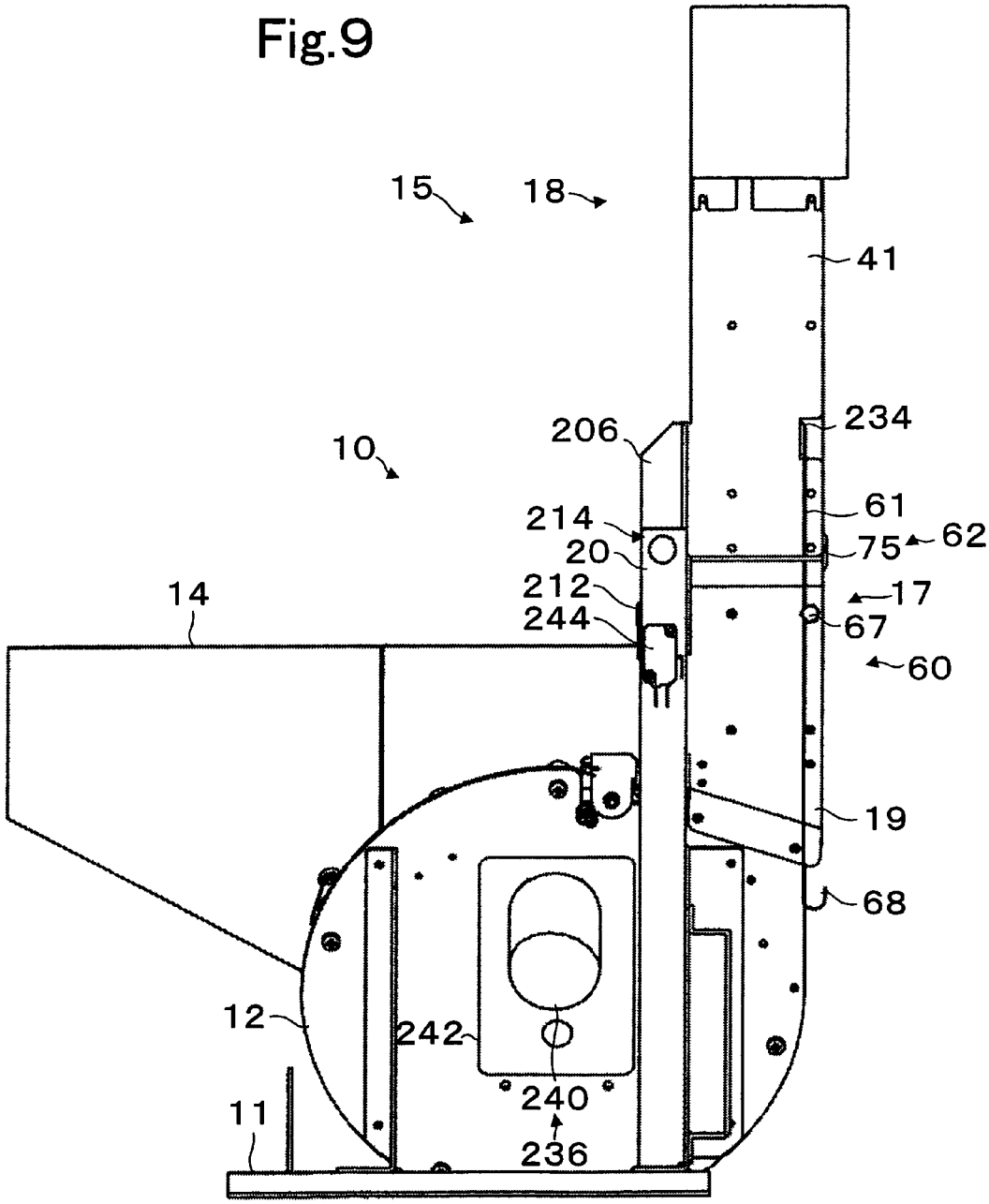
FIG. 9 is a rear view of the hopper with the second embodiment.
Figure 10:
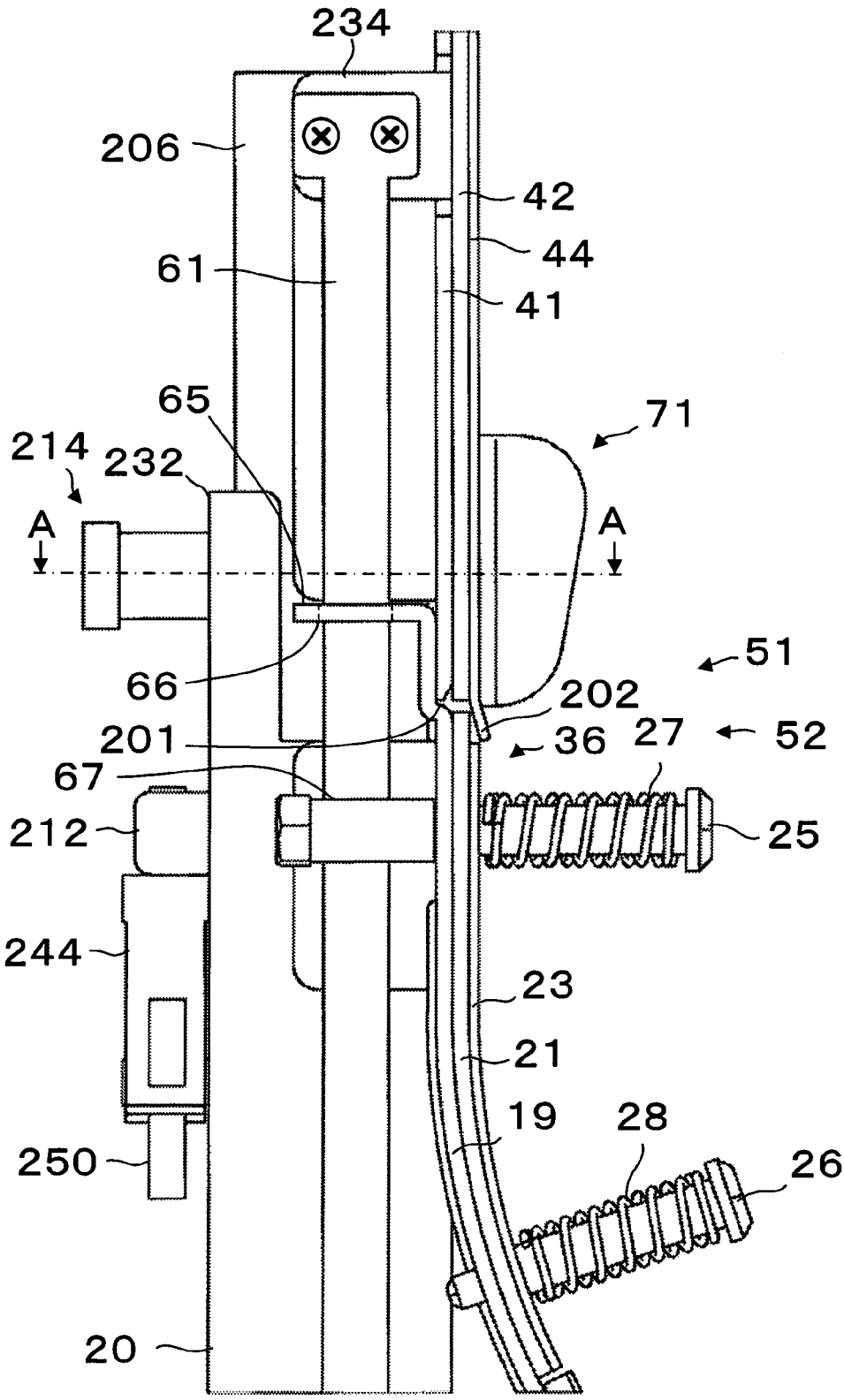
FIG. 10 is an enlarged left hand side view of the separating section of the second embodiment.
Figure 11:
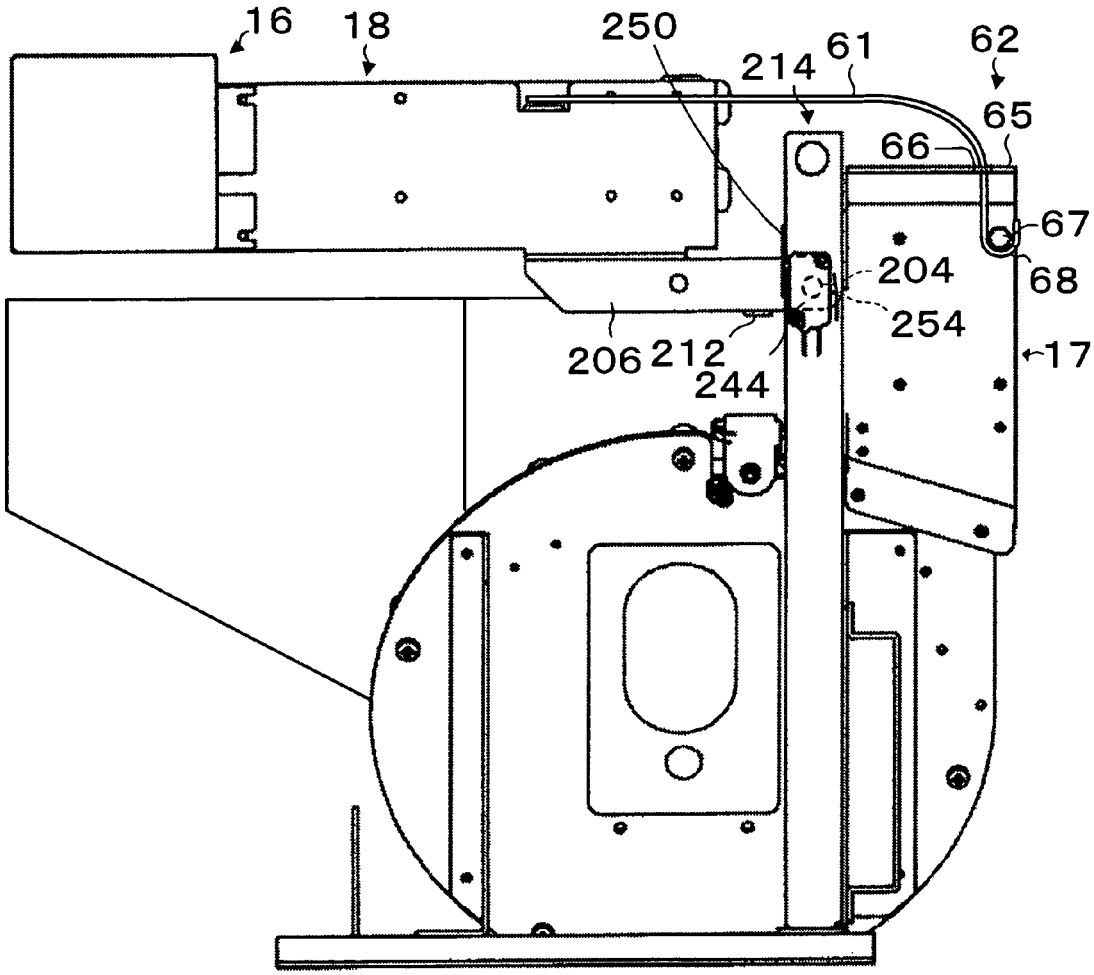
FIG. 11 is a rear view side of the hopper when the dispensing guiding unit is pivoted in the second embodiment.

Next, the separating operation between dispensing side guiding unit 18 and hopper side guiding unit 17 is explained. First, stopper 226 is held and moved by an operator, and slider 222 is taken away from through hole 230. Next, dispensing side guiding unit 18 is moved from the upright perpendicular position, as shown in FIG. 9, to the horizontal position shown in FIG. 11 in a counterclockwise direction.

In this process, the lower section of spring 61 is guided by guiding hole 66 and guiding bar 67. Therefore, the lower section is kept at the upright perpendicular situation, and spring 61 is bent or transformed to an arc shape. The pivoting speed of dispensing side guiding unit 18 is correspondingly reduced according to the amount of deformation. In addition, the deformation of spring 61 increases because stopper 68 is stopped by the guiding bar 67. Also projection 254 has contact with the inside wall of supporting body 20 and stops. As a result, the pivoting speed is drastically reduced.

Accordingly, dispensing side guiding unit 18 is separated from hopper side guiding unit 17. Also driven piece 250 is not pushed by operating piece 212. Therefore, micro switch 244 becomes "OFF", and the controlling circuit 238 is opened. In this situation, when contactor 246 becomes "ON", motor 240 does not rotate. As a result, discs D are not dispensed. When dispensing side guiding unit 18 is separated, discs D in dispensing side guiding passageway 47 fall down by gravity; however, they don't fall down in the same manner as in the first embodiment.

When dispensing side guiding unit 18 is combined with hopper side guiding unit 17 by reversing the steps of the above-mentioned procedure, the dispensing side guiding unit 18 pivots on shaft 204 and to a perpendicular position. Therefore, dispensing side base 19 is located on the extending line of hopper side base 19, dispensing side spacers 42,43 are located on each of the extending lines of hopper side spacers 21,22 and dispensing side supporters 44,45 are located on each of the extending lines of hopper side supporters 23,24.

If the pivoting plane is out of alignment, slanting sections 202 are guided by hopper side spacers 21,22 and the positions becomes the above-mentioned situation. Next stopper 226 is held by an operator, and slider 22 is moved, and pin section 228 is pulled into cylinder 218. Afterwards, lever 206 is pushed to stopper 232. Also slider 222 becomes free, and pin section 228 goes into through hole 230 by the force of spring 221. Therefore, dispensing side guiding unit 18 is fixed at hopper side guiding unit 17. As a result, guiding unit 15 is structured.

When the hopper is either in or out of the gaming machine, the dispensing side guiding unit 18 is removed as mentioned, and is fixed at hopper side guiding unit 17 by a one-touch fixing unit 214.

The structure of the third embodiment is hereinafter explained and the same reference numbers of embodiments 1 and 2 are used. The third embodiment doesn't include a buffering unit 60. Support 300 is perpendicularly fixed at base 11. A carrying handle 302 is gate-like in shape and is fixed at support 300 for hopper base 12. The other end of the carrying handle 302 is fixed at supporting body 20 and it reinforces the supporting body 20. Handling section 304 of carrying handle 302 is parallel to base 11 and is easy to grasp by an operator. In other words, when hopper 10 is in a gaming machine, the handling section 304 is level.

Fixing unit 80 of this embodiment is an automated fixing unit 306 which an operator doesn't have to operate. Next the automated fixing unit 306 is explained. Holding groove 310 slants downwards and is located at plate 308 which protrudes towards the side from the upper rear wall of supporting body 20.

Pin 316 protrudes towards the rear from convex section 314 of rear wall 312 of lever 206 which can pivot on shaft 204 together with dispensing side guiding unit 18. Pin 316 is cylinder-like in shape and can proceed into the holding groove 310. Hooking unit 318 is located adjacent to plate 308 and is located at the side of the rear wall of supporting body 20, and is pivotable on shaft 320 which penetrates from the rear wall of supporting body 20. Hooking unit 318 has a concave section 322 at the lower edge.

Figure 15:
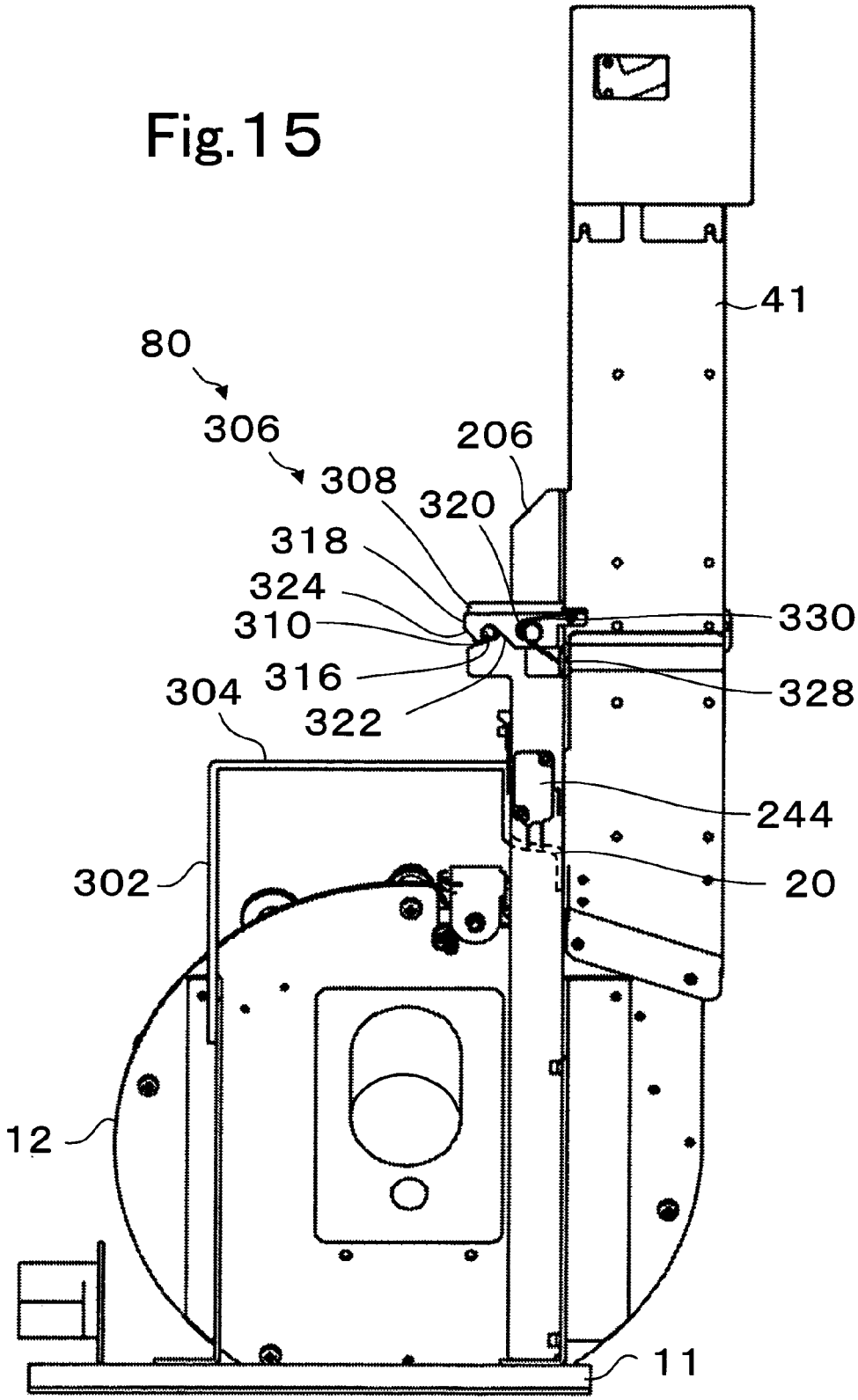
FIG. 15 is a rear view of the hopper with the guiding unit of the third embodiment detached the bowl.

When a part (the right side shown in FIG. 15) of pin 316 has contact at the furthest area of wall 323 of holding groove 310, it stops opposite of pin 316 (the left side shown in FIG. 15). Therefore, dispensing side guiding unit 18 is stopped in pivoting in the counterclockwise direction to a vertical position as shown in FIG. 15. The lower surface rather than the hook 322 of hooking unit 318 is a slanting surface 324 which slants downwards towards hook 322. The rear upper section of hooking unit 318 is bent approximately level and is rectangular and acts as a releasing section 326 for hooking unit 318.

Figure 17:
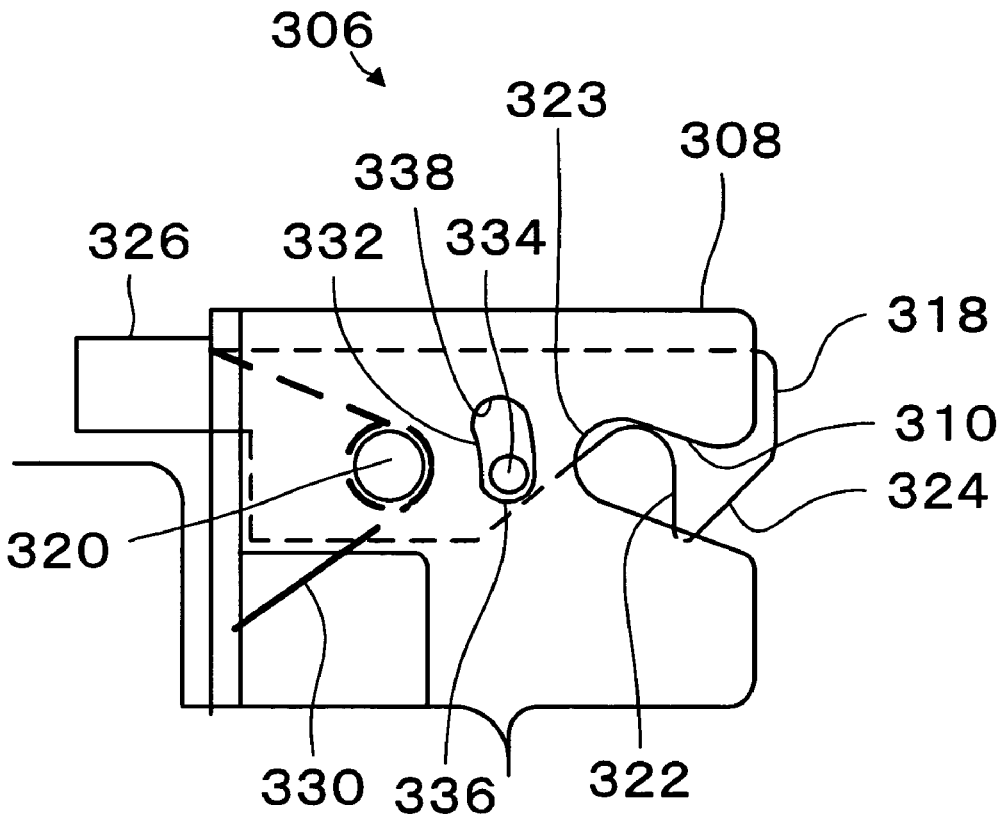
FIG. 17 is an enlarged front view of the automatic fixing unit of the third embodiment.
Figure 18:
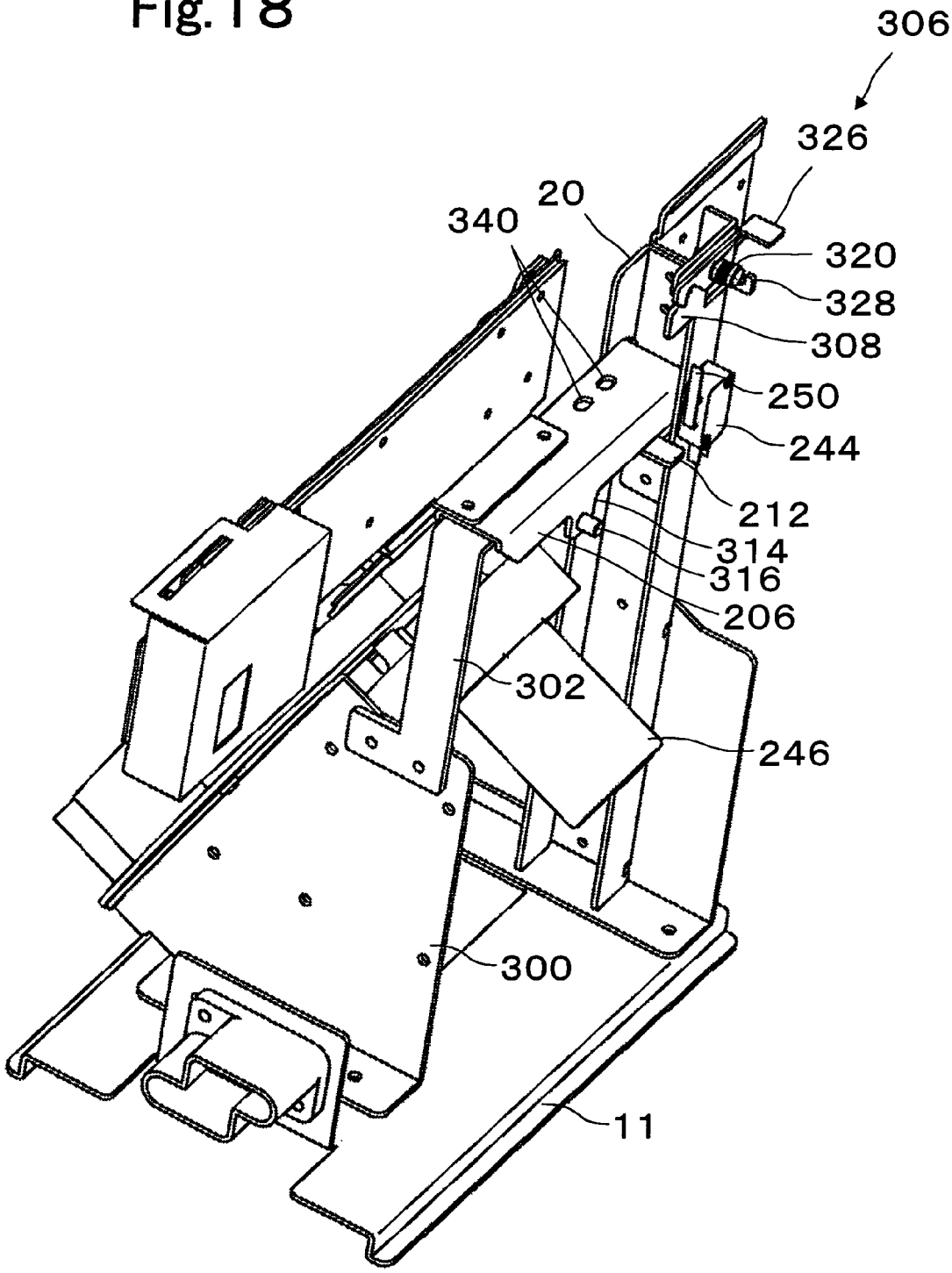
FIG. 18 is a rear perspective view of the hopper with the guiding unit which is laid down which is in the third embodiment.

The middle section of hooking unit 318 is wound on shaft 320, and an end is hooked at the lower surface of releasing section 326, also the other end is hooked at stopper 328 which protrudes from supporting body 20. Therefore, hooking unit 318 pivots in the counterclockwise direction as shown in FIG. 15. Also elongate hole 332 is arc-like in shape in the center where shaft 320 is shown in FIG. 17. Pin 334 penetrates from the side surface of hooking unit 318 and can be inserted into the arc elongate hole 332. Therefore, hooking unit 318 is pivoted by spring 330, also the pin 334 is stopped by a lower edge 336 of the arc elongate hole 332.

Figure 16:
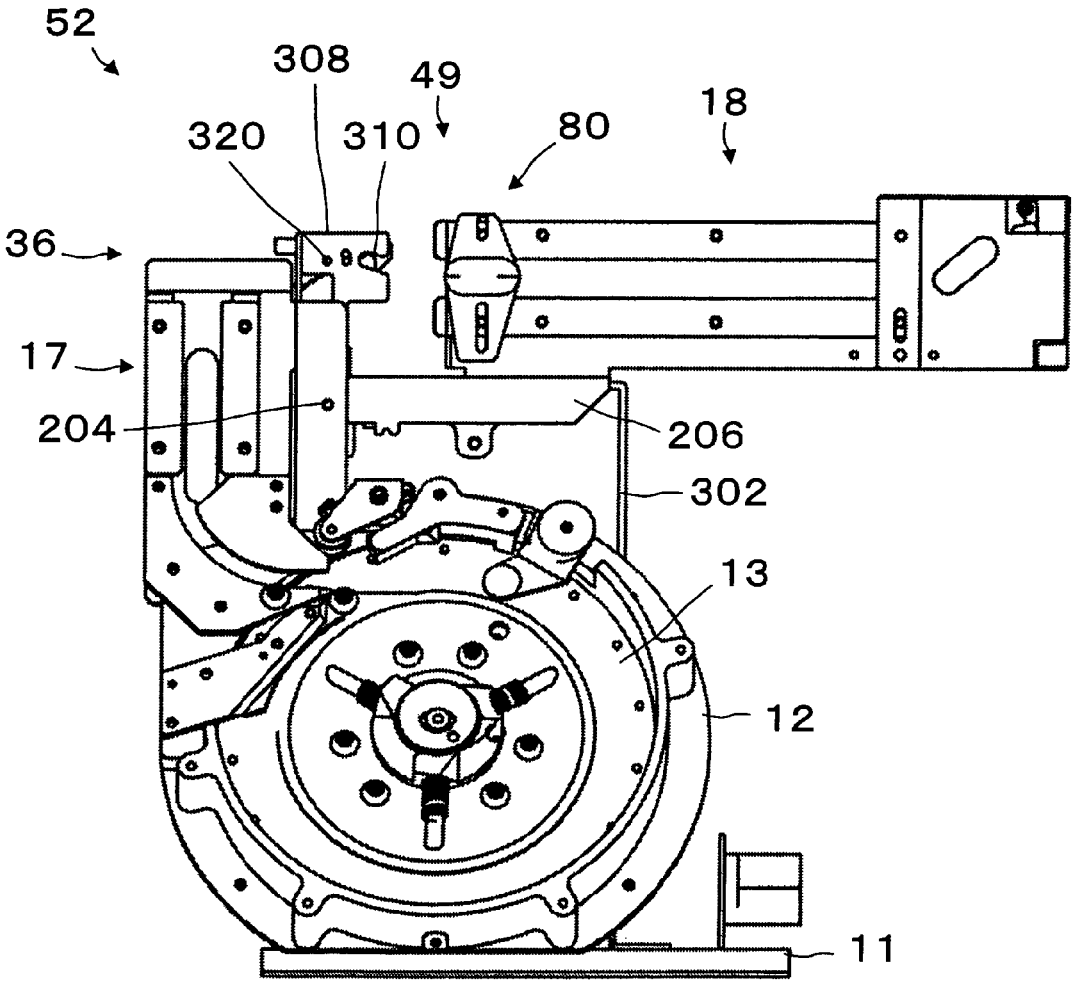
FIG. 16 is a front view of the hopper with the guiding unit which is laid down which is the third embodiment.

When releasing lever section 326 in FIG. 17 is pushed down, pin 334 is stopped by an upper edge 338 of arc elongate hole 332. In this situation, hooking unit 318 doesn't hook pin 316. Also, when dispensing side guiding unit 18 is moved as shown in FIG. 16, bottom wall 207 of lever 206 has contact with the upper surface of the middle section 304 of carrying handle 302 and is supported at that position. In this situation, screws can be screwed into the screw holes (not shown) of middle section 304 through elongate hole 340 of lever 206. Therefore, the lever 206 is fixed at middle section 304. As a result, dispensing side guiding unit 18 doesn't vibrate while being transported.

Next the operation of this third embodiment is explained. When dispensing side guiding unit 18 is moved from a folded position onto the extending line of hopper side guiding unit 17, pin 316 has contact with slanting surface 324. Therefore, pin 316 pushes up hooking unit 318 and pivots hooking unit 318 in the counterclockwise direction as shown in FIG. 17. When pin 316 has contact with the back wall 323 of arc elongate hole 310, slanting surface 324 is unhooked from pin 316.

Therefore, hooking unit 318 is pivoted in the counterclockwise direction by spring 330 as shown in FIG. 15, afterwards hook 322 hooks pin 316. As a result, hook 322 stops the returning movement of the dispensing side guiding unit 18. In other words, dispensing side guiding unit 18 is fixed. When the dispensing side guiding unit 18 is separated, releasing section 326 is pushed down; also hooking unit 318 is pivoted in the clockwise direction as shown in FIG. 15. In this situation, the upper edge 338 of arc elongate hole stops pin 334, Therefore, the over-pivoting of hooking unit 318 is prevented.

When pin 334 is stopped by upper edge wall 338, hook 322 unhooks pin 316. Therefore, dispensing side guiding unit 18 can pivot in the counterclockwise direction shown in FIG. 16 and becomes placed in a horizontal position. In this third embodiment, dispensing side guiding unit is automatically fixed by automatically fixing unit 306 based on the returning movement. Also, when dispensing side guiding unit 18 is positioned in a horizontal position, releasing section 326 is pushed down to make the operation easier.

Those skilled in the art will appreciate that various adaptations and modifications of the just-described preferred embodiment can be configured without departing from the scope and spirit of the invention. Therefore, it is to be understood that, within the scope of the amended claims, the invention may be practiced other than as specifically described herein.

What is claimed is:

1. A coin dispensing apparatus comprising:

a storage hopper for storing coins in bulk;

a selector unit for removing individual coins from the storage hopper;

a carrying handle for the coin dispensing apparatus which includes a middle section which is horizontal to a support surface; and a coin elevator unit that is removable and is attached to the selector unit for transporting coins to a dispensing position, the coin elevator unit is movable and is attached to the storage hopper to provide a first mode of operation for dispensing coins and a second mode of operation wherein any coins in the coins elevator unit are held stationary and the coin elevator unit is positioned at a different alignment from the first mode of operation relative to the storage hopper, in the second mode of operation, the coin elevator unit has contact with an upper surface of the middle section of the carrying handle, wherein fasteners can secure the coin elevator unit to the carrying handle.

2. The coin dispensing apparatus of claim 1 wherein the coin elevator unit includes a dispensing side guiding unit and a hopper side guiding unit, and a fixing unit for automatically locking the dispensing side guiding unit to the hopper side guiding unit to provide the first mode of operation.

3. The coin dispensing apparatus of claim 2 wherein the fixing unit includes a spring based fastener member for releasably holding the dispensing side guiding unit in an operative position with the hopper side guiding unit in the first mode of operation.

4. A coin dispensing apparatus comprising:

a storage hopper for storing coins in bulk;

a selector unit for removing individual coins from the storage hopper;

a coin elevator unit for dispensing coins including a hopper side guiding unit and a dispensing side guiding unit which is removably attached to the hopper side guiding unit for transporting coins to a dispensing position, the dispensing side guiding unit is movably attached to the storage hopper to provide a first mode of operation for dispensing coins and a second mode of operation wherein coins are not dispensed and the dispensing side guiding unit is positioned at a different alignment from the first mode of operation relative to the hopper side guiding unit;

a handle member is operatively mounted to permit manual lifting of the coin dispensing apparatus for transportation; and a fixing unit for automatically locking the coin elevator unit in the first mode of operation, includes a first member with a releasable locking unit permanently mounted above the selector unit and a second member with a complementary locking member for operative connection with the releasably locking unit, the second member enables a releasable fastening of the dispensing side guiding unit in the second mode of operation to the handle member and has a U-shaped cross sectional shape that can encompass a portion of the handle member.

5. The coin dispensing apparatus of claim 4 wherein the second member is pivotally connected to the hopper side guiding unit and in the second mode of operation the dispensing side guiding unit can be moved to be offset from any direct contact with the hopper side guiding unit.

6. The coin dispensing apparatus of claim 4 wherein the releasable locking unit is mounted above the pivotable connection to the hopper side guiding unit.

7. The coin dispensing apparatus of claim 4 wherein the fixing unit includes a spring based hook member for engaging a pin member.

8. The coin dispensing apparatus of claim 4 wherein the dispensing side guiding unit includes a housing member and a movable stopper member contained within the housing member for securing any coins in the dispensing side guiding unit when moved to a second mode of operation.

9. The coin dispensing apparatus of claim 8 wherein the movable stopper member is a ball.

10. The coin dispensing apparatus of claim 4 further including a switching unit for detecting when the dispensing side guiding unit is a second mode of operation and a motor for driving the selector unit, the switching unit stops power to the motor in the second mode of operation.

11. A guiding device for dispensing discs from a storage hopper comprising:

a disc guiding unit attached to the storage hopper to extend operatively for conveying discs in a first mode of operation and attached to the storage hopper to extend in a second non-operative mode of operation at a different alignment with the storage hopper;

means for providing discs to the disc guiding unit including an electric motor;

a switching unit for detecting when the disc guiding unit is in the second non-operative mode whereby when the disc guiding unit is in the second non-operative mode, the switching unit is OFF, and the electrical motor cannot operate;

a handle member operatively mounted to permit manual lifting of the storage hopper; and a fixing unit for automatically locking the disc guiding unit when engaged in the first mode of operation and permitting the disc guiding unit to contact the handle member in the second non-operative mode of operation whereby the disc guiding unit can be fastened adjacent the handle for transportation.

12. The guiding device of claim 11 wherein the disc guiding unit includes a hopper side guiding unit and a dispensing side guiding unit, the dispensing side guiding unit is pivotally connected to the hopper side guiding unit by a lever member whereby the dispensing side guiding unit can be offset from the hopper side guiding unit in the second non-operative mode.

13. The guiding device of claim 12 wherein the lever member is U-shaped in cross section and of a dimension to encompass a portion of the handle member.

14. The guiding device of claim 13 further including a hole provided in the lever member and a hole provided in the handle member that aligns in the second non-operative mode and a fastener for securing the handle member and the lever member by extending through the aligned holes.

* * * * *